US005975973A

United States Patent [19]

Fleming

[11] Patent Number: 5,975,973

[45] Date of Patent: Nov. 2, 1999

[54] SWIM FIN

[75] Inventor: Terry Fleming, Sydney, Australia

[73] Assignee: Sontaria Holdings Pty Ltd., Australia

[21] Appl. No.: 09/089,810

[22] Filed: Jun. 3, 1998

[30] Foreign Application Priority Data

Jun. 6, 1997 [AU] Australia ..... PO7256

[51] Int. Cl.[6] ..... A63B 31/08

[52] U.S. Cl. ..... 441/64

[58] Field of Search ..... 441/62, 63, 64; D21/239

[56] References Cited

U.S. PATENT DOCUMENTS 2,865,033 12/1958 Jayet ..... 441/64

5,358,439 10/1994 Paolo ..... 441/64

FOREIGN PATENT DOCUMENTS 762166 11/1956 United Kingdom ..... 441/64

94009860 5/1994 WIPO ..... 441/64

*Primary Examiner*—Stephen Avila

*Attorney, Agent, or Firm*—Londa and Traub LLP

[57] ABSTRACT

The present invention provides a swim fin with a foot pocket adapted to receive a specific foot of a user and having its end conforming substantially to the alignment of the toes of the user, a blade extending from the foot pocket to a free end and having an inner edge which faces the inner edge of the other swim fin and an outer edge, the free end of the blade substantially in line with and extending inwardly from the big toe side of the foot pocket extending further than the remaining free end of the blade.

7 Claims, 3 Drawing Sheets

SWIM FIN

BACKGROUND OF THE INVENTION

The present invention relates to swim fins used by swimmers and by body board riders.

Numerous attempts have been developed to assist scuba divers, swimmers, body board riders and swimmers. Whilst many attempts have been made to improve the performance in thrust and manoeuvrability of swim fins little or no thought has been given to solve the problem of the tendon soreness of the legs of a swimmer using swim fins.

SUMMARY OF THE INVENTION

The present invention seeks to ameliorate this problem by providing a swim fin comprising:

a foot pocket, adapted to receive a specific foot of a user, and having its end conforming substantially to the alignment of the toes of the user;

a blade, extending from the foot pocket to a free end, and having an inner edge, which, in use, faces the inner edge of the other swim fin, and an outer edge;

the free end of the blade, substantially in line with and extending inwardly from the big toe side of the foot pocket, extending further than the remaining free end of the blade.

BREIF DESCRIPTION OF THE DRAWINGS

The present invention will now be described, by way of example, with reference to the accompanying drawings, in which.

DETAILED DESCRIPTION OF THE INVENTION

Figure 1:
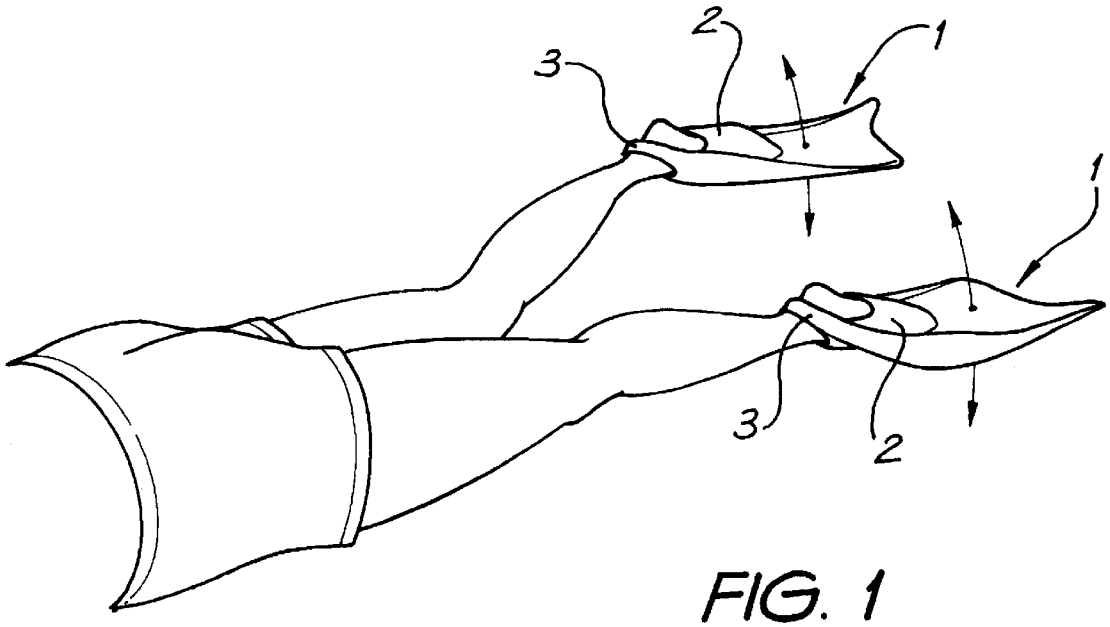
FIG. 1 PRIOR ART
FIG. 1 illustrates schematically a pair of prior art swim fins in use.
Figure 2:
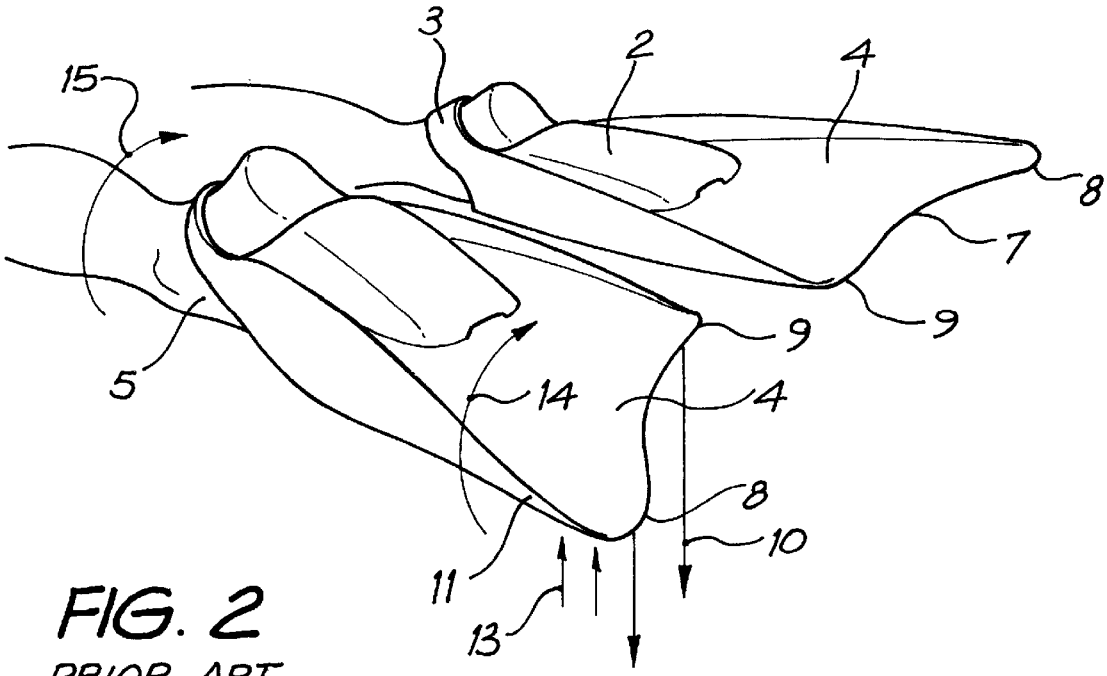
FIG. 2 PRIOR ART
FIG. 2 illustrates schematically a pair of prior art swim fins showing forces that act on the fin in use.

As shown in FIG. 1, swim fins (1) comprise a foot pocket (2), a strap (3) and a blade (4) terminating a in a free end (7). The swim fin is attached to a foot (5) of a user. The up and down kick of the legs (6) of a user propels the user through the water. All prior art swim fins (1) have the outer portion (8) of the free end (7) extending further the inner portion (9), and also the outer portion (8) extends to the outside of the foot pocket (2) a greater distance than the inner portion (9) extends to the inside of the foot pocket (2). Thus as the swim fin (1) moves downwardly in the direction of arrow (10), the water exerts an upward force against the lower surface of the swim fin (1). However as the outer portion (11) of the blade (4) which extends outside the line of the foot pouch (2) is larger than the inner portion (12) of the blade (4) there is a greater upward force (13) on the outer portion (11) of the blade (4) which causes a bending moment on the swim fin (1) twisting the swim fin (1) in the direction of arrow (14).

This twisting of the fin (1) causes a bending moment to the foot (5) to which it is attached. Because of the construction of the ankle, the foot (5) can rotate outwardly in the direction of the arrow (15), and as such the tendons and muscles associated with the ankle resist the twisting of the ankle. However this continuous repetition of pressure and release on these tendons and muscles causes undue strain and results in tendon soreness and, in extreme cases, tendon damage.

Figure 3:
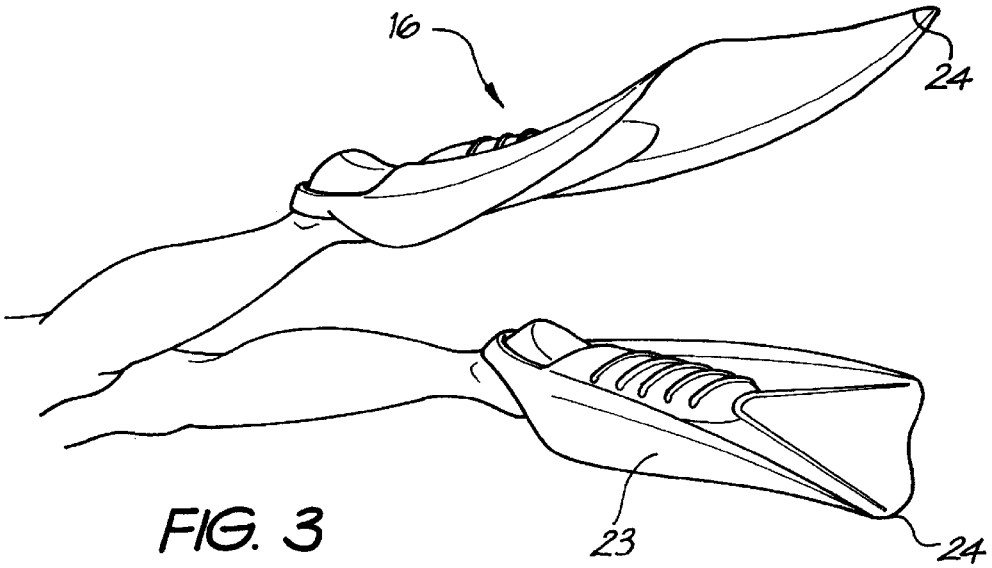
FIG. 3 illustrates a pair of swim fins in use according to one embodiment of the present invention.
Figure 4:
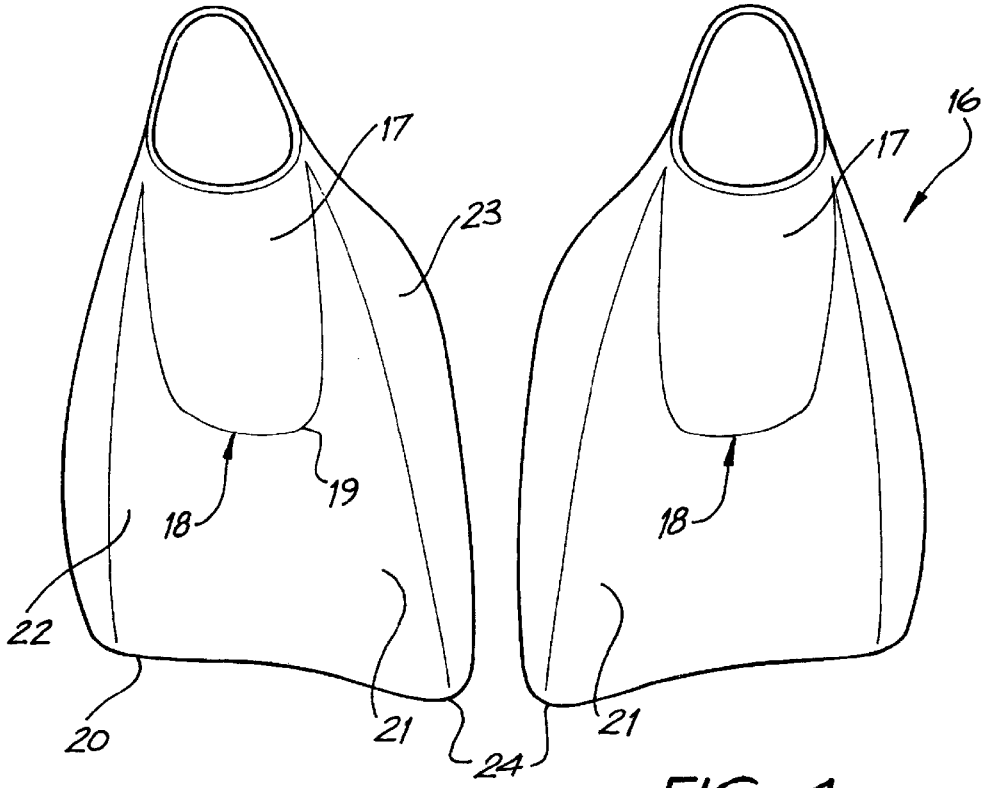
FIG. 4 illustrates a top view of a pair of the swim fins shown in FIG. 3.
Figure 5:
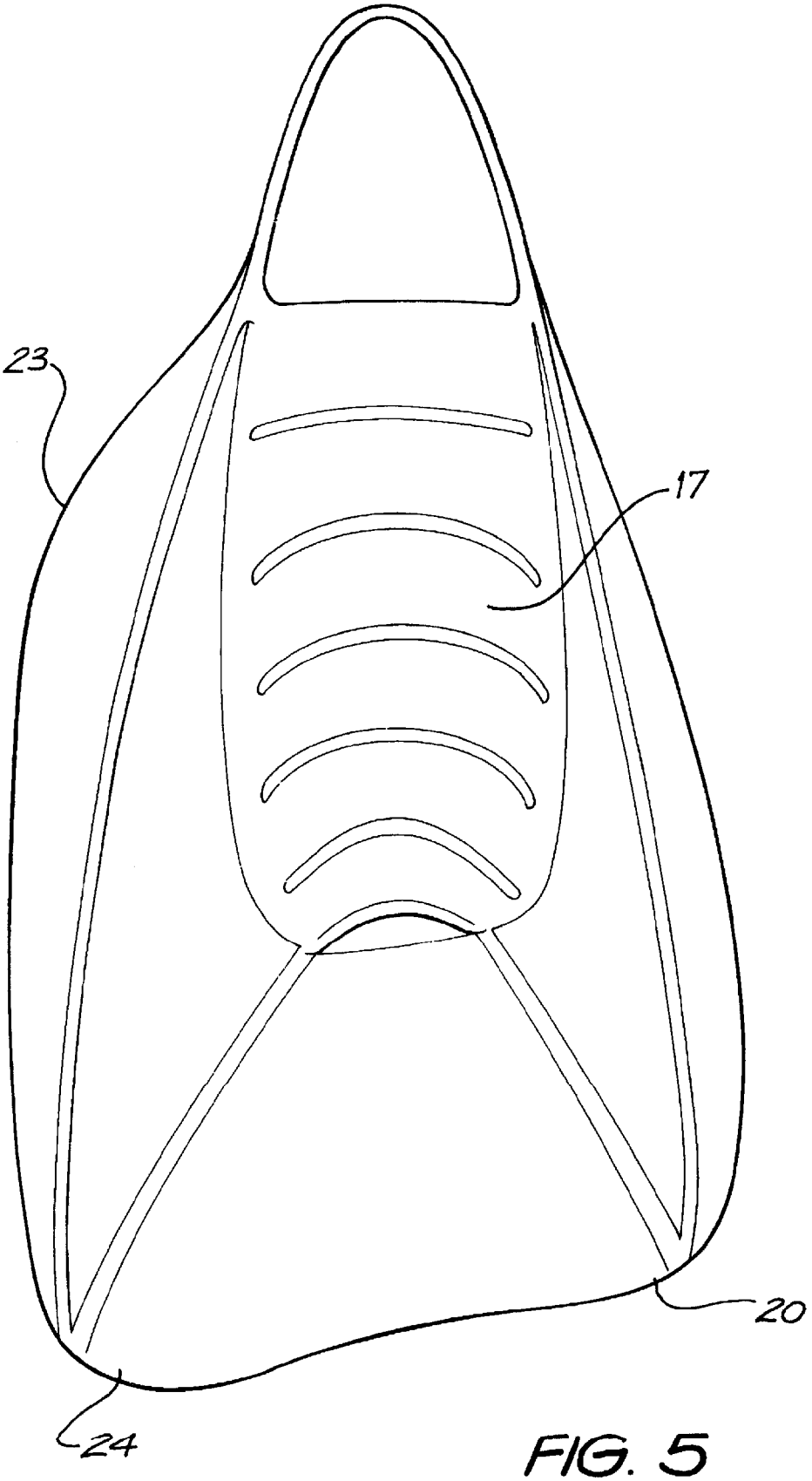
FIG. 5 illustrates a bottom view of the right foot swim fin shown in FIGS. 3 & 4.

The present invention seeks to overcome this problem. One embodiment of a swim fin (16) is shown in FIGS. 3, 4 & 5. The swim fin (16) is made similarly to existing swim fins (1) and has a foot pocket (17) which is made exclusively for a right or a left foot, and has the front edge (18) of the foot pocket shaped to conform to the sloping profile of the toes and hence the big toe side (19) of the front edge (18) of the foot pocket (17), extends ahead of the rest of the front edge (18) of the foot pocket (17). A strap (3) or like device holds the swim fin (16) onto the foot (5) of the user A blade (4) extends forwardly from the foot pocket (2).

However the fin (16) of the present invention differs from existing swim fins (1) in that the portion (24) of the free end (7) of the blade substantially aligned with and inward of the big toe side (19) of the foot pocket (17) extends beyond the remaining free edge (20). Further the inner portion (21) of the blade (4), which extends inside the line of the foot pocket (17,) is larger in area than the area of the outer portion (22) of the blade (4), which extends outside the line of the foot pocket (17).

Thus a larger force is exerted on the underside of the inner portion of the blade than on the outer portion of the blade during the down stroke of the fin (17), and a bending moment is exerted onto the fin and thus to the foot (5). However because of the construction of the ankle, the ankle cannot twist in this direction and hence no strain is placed on the associated tendons and muscles.

To assist in increasing the area of the inner portion (21) of the blade (4) a raised strake (23) begins near the foot pocket (2) and extends along the inner edge of the blade (4). This strake (23) also assists in retarding the spillover of water across the blade and hence increase the pressure in this area.

The fin can use a strap, as shown, to attach to the foot of a user, or be a shoe or a buckle strap. The swim fin can be made of any suitable material, and could be of any desired length depending whether it is used for swimming, body board riding or scuba diving.

It should be obvious to people skilled in the art that modifications and alterations can be made to the above described embodiment without departing from the scope and spirit of the present invention.

The claims are:

1. A swim fin comprising:

a foot pocket, having an opening at one end to receive a specific foot of a user, and having its other end conforming sustantially to the alignment of the toes of the user;

a blade, extending from the foot pocket, adjacent said opening to a free end, and having an inner edge, which, in use, faces the inner edge of the swim fin, and an outer edge;

the free end of the blade, substantially in line with and extending inwardly from the big toe side of the foot pocket, extending further than the remaining free end of the blade;

a raised inner strake, located on the upper surface of the blade and extending upwardly and outwardly therefrom and running along the inner edge of the blade from adjacent the opening of the foot pocket to the free end of the blade, the strake being so dimensioned that it acts as a driving surface and assists in retarding spillover of water across the blade and hence to increase pressure adjacent the foot pocket and to direct water along the blade so that the inner portion of the swim fin which extends inside the line of the foot pocket and its associated strake is larger in area than the area of the outer portion of the blade, which extends, outside the line of the foot pocket, thereby creating a greater force on the upper surface of the inner portion of the swim fin which extends inside the line of the foot pocket and its associated strake than the upper surface of the outer portion of the blade, which extends, outside the line of the foot pocket.

2. A swim fin according to claim 1, wherein the blade has on its upper surface, an outer strake running along the outer edge of the blade from adjacent the foot pocket to the free end of the blade.

3. A swim fin according to claim 2, wherein the top edge of the raised outer strake forms a convex arc along the inner edge of the blade, the arc having a highest point nearer the foot pocket than the free end of the blade.

4. A swim fin according to claim 2, wherein the blade has on its lower surface, a second raised inner strake running along the inner edge of the blade from adjacent the foot pocket to the free end of the blade, and a second raised outer strake running along the outer edge of the blade from adjacent the foot pocket to the free end of the blade.

5. A swim fin according to claim 4, wherein the raised inner strake extends from the upper surface of the blade to a distance greater than the distance that the second inner strake extends from the lower surface of the blade.

6. A swim fin according to claim 4, wherein the raised outer strake extends from the upper surface of the blade to a distance greater than the distance that the second outer strake extends from the lower surface of the blade.

7. A swim fin according to claim 1, wherein the top edge of the raised inner strake forms a convex arc along the inner edge of the blade, the arc having a highest point nearer the foot pocket than the free end of the blade.

* * * * *